US007874041B2

(12) United States Patent
Buller et al.

(10) Patent No.: US 7,874,041 B2
(45) Date of Patent: Jan. 25, 2011

(54) SUCTION TUBE FOR A VACUUM CLEANER

(75) Inventors: Kai Buller, Glandorf (DE); Dirk Wegener, Bielefeld (DE)

(73) Assignee: Miele & Cie. KG, Guetersloh (DE)

( * ) Notice: Subject to any disclaimer, the term of this patent is extended or adjusted under 35 U.S.C. 154(b) by 904 days.

(21) Appl. No.: 11/720,777

(22) PCT Filed: Nov. 17, 2005

(86) PCT No.: PCT/EP2005/012324

§ 371 (c)(1),
(2), (4) Date: Jun. 4, 2007

(87) PCT Pub. No.: WO2006/058616

PCT Pub. Date: Jun. 8, 2006

(65) Prior Publication Data

US 2010/0018001 A1 Jan. 28, 2010

(30) Foreign Application Priority Data

Dec. 3, 2004 (DE) ..... 10 2004 058 556

(51) Int. Cl.
*A47L 9/02* (2006.01)

(52) U.S. Cl. ..... 15/351; 15/410; 15/414; 285/7

(58) Field of Classification Search ..... 15/351, 15/414, 410; 285/7; *A47L 9/02*
See application file for complete search history.

(56) References Cited

U.S. PATENT DOCUMENTS

| | | | |
|---|---|---|---|
| 5,584,436 | A | 12/1996 | Sepke |
| 6,345,408 | B1 | 2/2002 | Nagai et al. |
| 2003/0098084 | A1 | 5/2003 | Ragner et al. |

FOREIGN PATENT DOCUMENTS

| | | |
|---|---|---|
| DE | 197 38 329 | 3/1999 |
| DE | 198 43 973 | 7/1999 |
| DE | 101 62 455 | 7/2003 |
| EP | 0976358 | 2/2000 |
| GB | 2 310 369 | 8/1997 |
| WO | 86/07247 | 12/1986 |
| WO | 03/024294 | 3/2003 |
| WO | 2004/096002 | 11/2004 |

*Primary Examiner*—David A Redding
(74) *Attorney, Agent, or Firm*—Leydig, Voit & Mayer, Ltd.

(57) ABSTRACT

A suction hose for vacuum cleaner includes a tubular inner part, a jacket part and a locking device. The inner part is variable in length and includes a hose wall having a coil spring integrated therein, the coil spring being configured to automatically return the inner part from an extended position to a shortened position. The jacket part is configured to completely receive the inner part when the inner part is in the shortened position, the jacket part including a tubular shape. The locking device is configured to fix the inner part, in the shortened position, in the jacket part. The locking device includes a tubular member configured to surround the inner part, the tubular member including a first part of a first snap-fit device configured to cooperate with the jacket part so as to connect the tubular member and the jacket part.

20 Claims, 2 Drawing Sheets

SUCTION TUBE FOR A VACUUM CLEANER

CROSS REFERENCE TO PRIOR APPLICATION

This is a U.S. national phase application under 35 U.S.C. §371 of International Patent Application No. PCT/EP2005/012324, filed Nov. 17, 2005, and claims benefit of German Patent Application No. 10 2004 058 556.3, filed Dec. 3, 2004, which is incorporated by reference herein. The International Application was published in German on Jun. 8, 2006 as WO 2006/058616 A1 under PCT Article 21(2).

The present invention relates to a suction hose for vacuum cleaners, including a tubular inner part which is variable in length and has integrated into its hose wall a tension spring which automatically returns the inner part from an extended position to a shortened position, the suction hose further including a jacket part which is also tubular and completely receives the inner part when said inner part is in its shortened position and in which the inner part can be fixed in the shortened position by means of a locking device. The present invention further relates to a vacuum cleaner having a suction hose, a suction nozzle, and possibly a suction wand to be disposed between the suction nozzle and the suction hose.

BACKGROUND

Suction hoses having a thin hose wall into which is integrated a tension spring that allows such hoses to be pulled from a shortened position to an extended position are generally known to be used in upright-type vacuum cleaners. In the case of such vacuum cleaners, such suction hoses are offered as additional vacuum attachments to allow cleaning of objects which are located at a higher position. The suction hoses are also referred to as "flex hoses".

British Patent Application GB 2 310 369 A describes an embodiment of a vacuum cleaner, where a suction hose is located between the handle of a suction wand and the end fitting. Said suction hose is a combination of a flex hose and a conventional suction hose that is only slightly variable in length. When in the park position, the flex hose is received in the handle in the fully contracted position. In this position, the lower portion of the flex hose is exposed. In the vacuum cleaner described in GB 2 310 369, the intention is to use a flex hose that can be extended to six times its length. Such highly flexible hoses have a very thin hose wall which is easily damaged by sharp corners. The exposed portion of the flex hose is also prone to damage in the park position when the user lets the suction wand fall down. When using a flex hose which has a greater wall thickness and may therefore only be extended to five times its length, a hose that has a sufficient length when extended (about 1.50 m to 2 m) would have a length of 30 cm to 40 cm when in the park position. A handle capable of receiving such a hose would be very clumsy in appearance and hard to maneuver.

German Patent Applications DE 198 43 973 A1 and DE 197 38 329 A1 describe hose systems which use integrated compression springs and which, therefore, move automatically from a park position to an extended position. These embodiments require complex valve arrangements to return the hose from the position of use to the park position, and the suction hose cannot be used when in the park position. Moreover, these vacuum cleaners are designed such that the entire suction hose is formed as a flex hose and, therefore, is completely received in the jacket tube. Therefore, very long, unwieldy jacket tubes are needed, or highly expandable hoses that are very thin in wall thickness and have a corresponding susceptibility to damage.

SUMMARY

It is, therefore, an aspect of the present invention to provide a suction hose which can easily be added as an adapter member to a vacuum cleaner having a conventional hose which is only slightly variable in length.

In an embodiment, the present invention provides a suction hose for vacuum cleaner. The suction hose includes a tubular inner part, a jacket part and a locking device. The inner part is variable in length and includes a hose wall having a coil spring integrated therein, the coil spring being configured to automatically return the inner part from an extended position to a shortened position. The jacket part is configured to receive the inner part when the inner part is in the shortened position, the jacket part including a tubular shape. The locking device is configured to fix the inner part, in the shortened position, in the jacket part. The locking device includes a tubular member configured to surround the inner part, the tubular member including a first part of a first snap-fit device configured to cooperate with the jacket part so as to connect the tubular member and the jacket part.

Another aspect of the present invention is to provide a vacuum cleaner in a simple manner with a suction hose that is variable in length.

In another embodiment, the present invention provides a vacuum cleaner. The vacuum cleaner includes a suction nozzle and a suction hose. The suction hose includes a first suction hose portion and a second suction hose portion, the second suction hose portion being disposed between an end of the first suction hose portion and the suction nozzle. The second suction hose portion includes a tubular inner part, a jacket part and a locking device. The tubular inner part is variable in length and includes a hose wall having a coil spring integrated therein, the coil spring being configured to automatically return the inner part from an extended position to a shortened position. The jacket part is configured to receive the inner part when the inner part is in the shortened position, the jacket part including a tubular shape. The locking device is configured to fix the inner part, in the shortened position, in the jacket part. The locking device includes a tubular member configured to surround the inner part, the tubular member including a first part of a first snap-fit device configured to cooperate with the jacket part so as to connect the tubular member and the jacket part.

BRIEF DESCRIPTION OF THE DRAWINGS

An exemplary embodiment of the present invention is shown in the drawings in a schematic way and will be described in more detail below. In the drawings.

DETAILED DESCRIPTION

The inventive embodiment of the suction hose provides a design which is easy to manufacture and use. Because a tubular member is used as a locking device, it can easily be provided with the functions described hereinbelow.

In an advantageous embodiment, the tubular member is provided with a part of an additional snap-fit mechanism which allows the tubular member to be connected to a handle of a suction wand or to a suction nozzle. This allows the suction hose to be employed as an intermediate piece between a conventional suction hose and handle, and thus, to be used only when needed.

It is advantageous if the two snap-fit mechanisms are designed to allow free rotation of the tubular member. Due to the helical shape of the tension spring, the inner part tends to twist when being pulled out of the jacket part. The free rotation of the tubular member ensures that the rotation of the inner part is accommodated, and does not result in looping. It is advantageous if the freely rotatable snap-fit mechanism includes at least one resiliently mounted latching nose and a groove extending circumferentially in the inner surface of the mating part.

The latching noses used to connect the jacket part to the tubular member should be disposed on the jacket part, while the latching noses used to connect the tubular member to the handle or to the suction nozzle should be disposed on the tubular member. This allows the user to clearly see which latching nose is intended for locking or releasing the jacket part, and which one is intended for attachment of the suction hose.

Ease of manufacture is facilitated by securing the inner part within the jacket part and the tubular member by means of end sleeves which are attached to the ends of the inner part and whose outside radii are larger than the smallest inner radii of the tubular member and the jacket part, respectively. To accomplish the assembly, it is then only necessary to pass the inner part through the jacket part and the tubular member, and then mount an end sleeve on each end. For this purpose, the end sleeves can be provided with an external thread to receive a few spirals of the coil spring. The inner part and the end sleeve can additionally be glued or welded together to provide a secure connection.

In addition, it is advantageous if the inner part is secured within the tubular member such that it can freely rotate.

The jacket part should be flexible in structure to prevent damage thereto and to provide sufficient maneuverability. The length of the inner part is preferably less than 50 cm. Advantageously, the length of the inner part in the maximally extended position is about three to five times its length in the shortened position. As a result, the suction hose is provided with a sufficient length while at the same time having a wall thickness that is capable of withstanding higher loads without being damaged.

Figure 1:
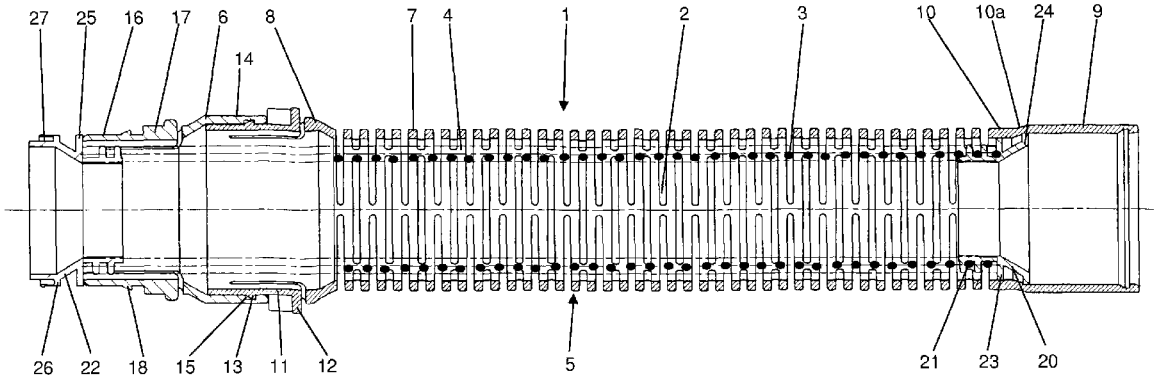
FIG. 1 is a cross-sectional view through a suction hose designed in accordance with the present invention.
Figure 2:
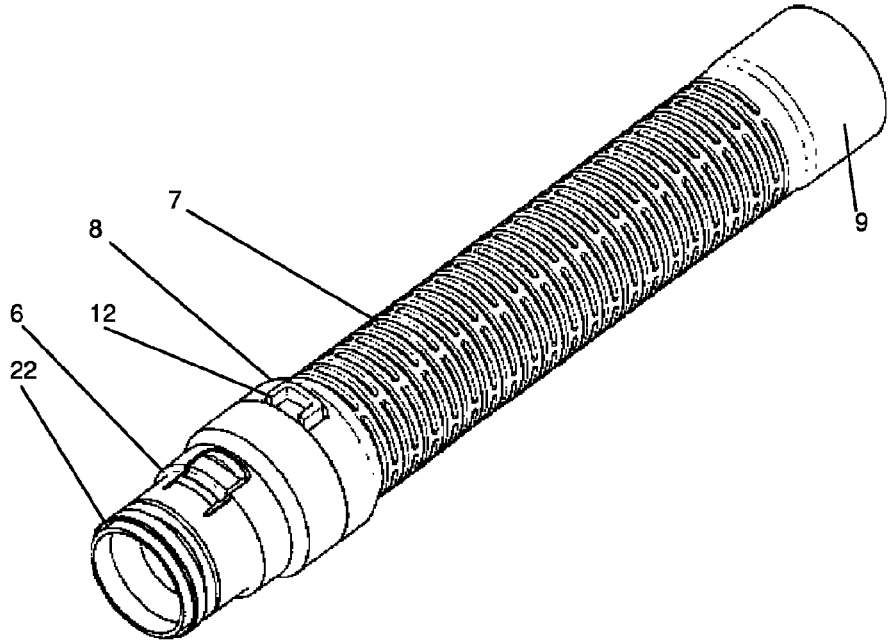
FIG. 2 is a perspective view of the suction hose of FIG. 1.

Suction hose 1, which is shown isolated in FIGS. 1 and 2, has a flexible inner part 2, which is shown in FIG. 1 hose in dashed lines. This inner part 2 is formed of a highly elastic plastic hose, such as a thin-walled PVC hose, having a coil spring 3 (symbolized by the dots in FIG. 1) integrated into its hose wall 4. Coil spring 3 is under tension such that it is trying to automatically contract. Because of this, the extended inner part 2 also automatically returns to a shortened position, during which process hose wall 4 is pleated in the region between the spirals of the coil spring. The maximum achievable length of inner part 2 is equal to the length of hose wall 4 in the unpleated state, including a possible elongation component. In the shortened position, the length of inner part 2 is less than 50 cm, preferably about 30 cm. The length and elasticity of the hose wall are designed to allow an increase in length by a factor of about 3 to 5. To assemble suction hose 1, inner part 2 is passed through a jacket part 5 and through a tubular member 6.

Jacket part 5 includes a flexible middle part 7 and two tubular end parts 8 and 9. End part 9, shown to the right in FIG. 1, has a portion 10*a* of tapering inside diameter at the end 10 facing middle part 7. End part 8, shown to the left in FIG. 1, is provided with U-shaped incisions on both sides, forming two spring tabs 11 which are movable in a radial direction relative to jacket tube 5. Each of these tabs 11 has formed thereon a grip 12 and a projection which acts as a latching nose 13.

Tubular member 6 includes a first section 14 of larger diameter, which serves to receive the end of the jacket part with its latching noses 13. In this process, the latching noses engage with a circumferential groove 15 and thus, together with groove 15, form a snap-fit mechanism which allows tubular member 6 to rotate freely, even when in a snapped-on position. A second section 16 of the tubular member has a smaller diameter than the first section. This section is provided with two opposed additional spring tabs 17 which are similar in configuration to spring tabs 11 of jacket part 5, and therefore also act as parts of a snap-fit mechanism. Latching noses 18 of said spring tabs 17 engage with a circumferential groove in the inner wall of a handle 19 (see FIG. 3) which, in turn, is connected to a suction wand. Alternatively or additionally, the snap-fit mechanism can also connect the suction wand itself and the suction nozzle, which is usually releasably attached to the suction wand.

To accomplish the assembly, jacket part 5 and tubular member 6 are latched together after which inner part 2 is simply passed through these two elements 5 and 6 until one end of inner part 2 protrudes from end part 9 of the jacket tube, which is the end part shown to the right in FIG. 2. An end sleeve 20 is then screwed onto this end. For this purpose, end sleeve 20 is provided with an external thread 21 to receive a few spirals of the coil spring 3 which is integrated into hose wall 4 of inner part 2. In addition to the frictional and form fit created in this manner, inner part 2 and end sleeve 20 can additionally be glued or welded together to provide a secure connection. The other end of inner part 2 is then pulled out of end of tubular member 6 that is shown to the left in FIG. 2, and is provided with an end sleeve 22, which is attached in the same manner. The two end sleeves 20 and 22 each have an inner flange 23 or 25 and an outer flange 24 or 26, respectively; the inner flanges 23 and 25 being smaller in diameter than the respective outer flanges 24 and 26. This allows inner flange 23 of right end sleeve 20 to slide into tapering portion 10*a* of end part 9, while outer flange 24 bears against tapering portion 10*a*, preventing inner part 2 from being pulled into jacket part 5. Left end sleeve 22 bears with inner flange 25 against the edge of tubular member 6, and can therefore rotate freely relative to tubular member 6. In the region of outer flange 26, this sleeve 22 is provided with a circumferential, axially oriented groove 27 into which is inserted a seal which is not shown in the drawings.

The length of jacket part 5, including the snapped-on tubular member 6, is sized to be at least slightly greater than the length of inner part 2 when in the contracted position, i.e., in the shortest possible position. Because of this, inner part 2 is always slightly tensioned, which makes it significantly easier to bring jacket part 5 and tubular member 6 together, which is necessary for locking engagement, and to insert tubular member 6 into handle 19 when inner part 2 is in a locked position.

Figure 3:
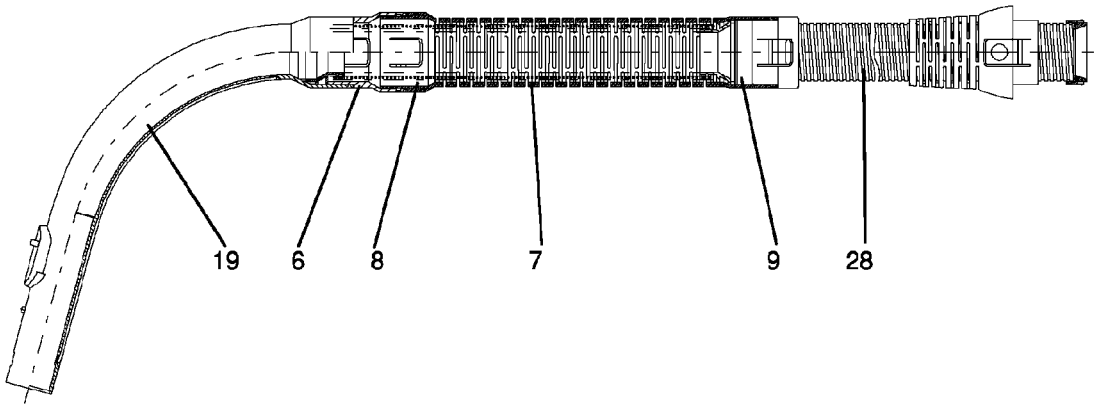
FIG. 3 is a view showing the suction hose mounted with other parts of a vacuum cleaner.

FIG. 3 shows the suction hose installed in an advantageous position. Here, the suction hose is snap-fitted between the handle 19 of a suction wand and the suction hose 28 that is included in the standard delivery of a vacuum cleaner and which is only slightly variable in length. Thus, it serves as a hose extension which may be used as needed by releasing the locking engagement of inner part 2 and pulling the inner part out of jacket part 5.

What is claimed is:

1. A suction hose for vacuum cleaner, the suction hose comprising:

a tubular inner part, the inner part being variable in length and including a hose wall having a coil spring integrated therein, the coil spring being configured to automatically return the inner part from an extended position to a shortened position;

a jacket part configured to receive the inner part when the inner part is in the shortened position, the jacket part including a tubular shape; and a locking device configured to fix the inner part, in the shortened position, in the jacket part, the locking device including a tubular member configured to surround the inner part, the tubular member including a first part of a first snap-fit device configured to cooperate with the jacket part so as to connect the tubular member and the jacket part, wherein the tubular member includes a first part of a second snap-fit device configured to connect the tubular member to a handle of a suction wand or to a suction nozzle.

2. The suction hose as recited in claim 1 wherein the first and second snap-fit devices are configured to allow free rotation of the tubular member.

3. The suction hose as recited in claim 2 wherein at least one of the first and second snap-fit devices includes a resiliently mounted latching nose and a groove extending circumferentially in an inner surface of a mating part.

4. The suction hose as recited in claim 1 wherein the jacket part includes a second part of the first snap-fit device, the second part of the first snap-fit device including a first resiliently mounted latching nose, and wherein the first part of the second snap-fit device including a second resiliently mounted latching nose.

5. The suction hose as recited in claim 4 wherein the first part of the first snap-fit device includes a first groove, and wherein the second snap-fit device includes a second part, the second part of the second snap-fit device including a second groove.

6. The suction hose as recited in claim 1 wherein the inner part is secured to the jacket part using a first end sleeve attached to a first end of the inner part and having an outside radius larger than a smallest inner radius of the jacket part, and wherein the inner part is secured to the tubular member using a second end sleeve attached to a second end of the inner part and having a respective outside radius larger than a smallest inner radius of the tubular member.

7. The suction hose as recited in claim 6 wherein each of the first and second end sleeves include a respective external thread configured to receive at least one respective spiral of the coil spring.

8. The suction hose as recited in claim 7 wherein the inner part and at least one of the first and second end sleeves are at least one of glued and welded together.

9. The suction hose as recited in claim 6 wherein the inner part is attached to the tubular member in a freely rotatable manner.

10. The suction hose as recited in claim 1 wherein the jacket part includes a flexible structure.

11. The suction hose as recited in claim 1 wherein a length of the inner part is less than 50 cm.

12. The suction hose as recited in claim 1 wherein the inner part is extendible in length to a maximally extended position, a length of the inner part in the extended position being about three to five times a length of the inner part in the shortened position.

13. The suction hose as recited in claim 1 wherein the inner part is returnable to a minimum shortened position, a combined length of jacket part and the snapped-connected tubular member being greater than a length of inner part in the shortened position.

14. The suction hose as recited in claim 1 wherein the jacket part is configured to substantially completely receive the inner part when the inner part is in the shortened position.

15. A vacuum cleaner comprising:

a suction nozzle; and a suction hose including a first suction hose portion and a second suction hose portion, the second suction hose portion being disposed between an end of the first suction hose portion and the suction nozzle, the second suction hose portion including:

a tubular inner part, the inner part being variable in length and including a hose wall having a coil spring integrated therein, the coil spring being configured to automatically return the inner part from an extended position to a shortened position;

a jacket part configured to receive the inner part when the inner part is in the shortened position, the jacket part including a tubular shape; and a locking device configured to fix the inner part, in the shortened position, in the jacket part, the locking device including a tubular member configured to surround the inner part, the tubular member including a first part of a first snap-fit device configured to cooperate with the jacket part so as to connect the tubular member and the jacket part.

16. The vacuum cleaner as recited in claim 15 wherein the first suction hose portion is slightly variable in length.

17. The vacuum cleaner as recited in claim 15 further comprising a suction wand disposed between the suction nozzle and the suction hose.

18. The vacuum cleaner as recited in claim 15 wherein the tubular member includes a first part of a second snap-fit device configured to connect the tubular member to a handle of a suction wand or to a suction nozzle.

19. The vacuum cleaner as recited in claim 15 wherein the jacket part is configured to substantially completely receive the inner part when the inner part is in the shortened position.

20. A suction hose for vacuum cleaner, the suction hose comprising:

a tubular inner part, the inner part being variable in length and including a hose wall having a coil spring integrated therein, the coil spring being configured to automatically return the inner part from an extended position to a shortened position;

a jacket part configured to receive the inner part when the inner part is in the shortened position, the jacket part including a tubular shape; and a locking device configured to fix the inner part, in the shortened position, in the jacket part, the locking device including a tubular member configured to surround the inner part, the tubular member including a first part of a first snap-fit device configured to cooperate with the jacket part so as to connect the tubular member and the jacket part, wherein the inner part is secured to the jacket part using a first end sleeve attached to a first end of the inner part and having an outside radius larger than a smallest inner radius of the jacket part, and wherein the inner part is secured to the tubular member using a second end sleeve attached to a second end of the inner part and having a respective outside radius larger than a smallest inner radius of the tubular member.

* * * * *